US009637273B2

(12) United States Patent
Pendergraph et al.

(10) Patent No.: US 9,637,273 B2
(45) Date of Patent: May 2, 2017

(54) HANG TAG PACKAGE FOR A SAW BLADE

(71) Applicants: Robert Bosch Tool Corporation, Broadview, IL (US); Robert Bosch GmbH, Stuttgart (DE)

(72) Inventors: Melvin A. Pendergraph, Arlington Heights, IL (US); Crystal Williams, Lansing, IL (US); Brian Vogeley, Woodstock, GA (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 124 days.

(21) Appl. No.: 14/541,016

(22) Filed: Nov. 13, 2014

(65) Prior Publication Data

US 2015/0175346 A1 Jun. 25, 2015

Related U.S. Application Data

(60) Provisional application No. 61/919,862, filed on Dec. 23, 2013.

(51) Int. Cl.

| | |
|---|---|
| ***A45C 11/26*** | (2006.01) |
| ***B65D 25/22*** | (2006.01) |
| ***B65D 73/00*** | (2006.01) |

(52) U.S. Cl.

CPC ..... *B65D 25/22* (2013.01); *B65D 73/0014* (2013.01); *B65D 73/0071* (2013.01)

(58) Field of Classification Search

CPC B65D 25/22; B65D 73/0014; B65D 73/0064; B65D 73/0071; A45C 11/26

USPC ..... 206/349, 372, 242, 351, 375, 525, 756, 206/736, 745, 751, 772, 769, 207, 205, 206/234, 317, 355, 443, 775, 779, 477, 206/488, 495, 493, 1.5, 806, 467, 470; 220/243, 314

See application file for complete search history.

(56) References Cited

U.S. PATENT DOCUMENTS

| | | | | |
|---|---|---|---|---|
| 3,130,834 A * | 4/1964 | Korzaan | ..... | B65D 73/0007 206/349 |
| 5,528,811 A * | 6/1996 | Abidin | ..... | A61B 17/3215 206/352 |
| 5,713,467 A | 2/1998 | Kao | | |

(Continued)

FOREIGN PATENT DOCUMENTS

DE 8901957 U1 5/1989

OTHER PUBLICATIONS

International Search Report and Written Opinion corresponding to PCT Application No. PCT/EP2014/078072 (12 pages).

*Primary Examiner* — J. Gregory Pickett
*Assistant Examiner* — Rafael Ortiz
(74) *Attorney, Agent, or Firm* — Maginot Moore & Beck LLP

(57) ABSTRACT

A package for at least one saw blade defining a post opening includes a body defining a support surface, a post, a wall, and a cover. The post extends from the support surface and is configured to extend through the post opening defined in at least one saw blade. The wall extends from the support surface at least partially around the post. The cover is configured for connection to the wall and is further configured to be positioned adjacent to a free end of the post when connected to the wall to prevent removal of the post from the post opening when the at least one saw blade is mounted on the post.

15 Claims, 8 Drawing Sheets

(56) References Cited

U.S. PATENT DOCUMENTS

| | | | | |
|---|---|---|---|---|
| 5,988,381 | A | 11/1999 | Ling | |
| 6,161,686 | A * | 12/2000 | Simon | A45C 11/16 206/6.1 |
| 6,164,447 | A * | 12/2000 | Svetlik | B23D 59/00 206/373 |
| 7,303,116 | B2 * | 12/2007 | Cervera Cunill | B65D 9/14 220/324 |
| 7,815,044 | B2 * | 10/2010 | Kasubowski | B23D 59/00 206/303 |
| 2004/0199167 | A1 * | 10/2004 | Fletcher | A61B 17/14 606/79 |
| 2005/0133389 | A1 | 6/2005 | Baublitz et al. | |
| 2013/0020217 | A1 | 1/2013 | Alexander et al. | |

* cited by examiner

HANG TAG PACKAGE FOR A SAW BLADE

This application claims the benefit of priority of U.S. provisional application Ser. No. 61/919,862, filed on Dec. 23, 2013, the disclosure of which is herein incorporated by reference in its entirety.

FIELD

This disclosure relates to the field of product packaging and in particular to product packaging for tool accessories, such as saw blades and the like.

BACKGROUND

Display packages enable most types of tools and tool accessories to be displayed for sale at a retail outlet by hanging the packaged product on rods or hooks that extend from a wall or display case. These display packages, which are commonly known as hang tag packages, are typically designed to hold a product in a manner that is both convenient for operators of the store and potential purchases of the product.

Store operators typically prefer a display package that includes a standard size hanging slot for placing the display package on a standard rod or hook, as is used in most stores. Additionally, store operators prefer a display package that is configured to support a security device, such as a radio frequency identification ("RFID") tag, to deter theft. Furthermore, it is desirable for display packages to be tamper resistant to ensure that the security device remains supported by the display package until after purchase.

Most display packages clearly display the packaged product so that a potential purchaser is able to evaluate the product prior to purchase. In particular, display packages for tools and tool accessories are typically designed to retain the tool or tool accessory in a safe manner while leaving as much of the tool or tool accessory exposed for easy viewing by a potential purchaser. For example, in displaying tools and tool accessories that have a cutting edge, it is a common practice for display packages to cover the cutting edge in some manner so that the cutting edge is prevented from posing a risk to purchasers or store operators. As opposed to store operators, purchasers typically prefer a display package that is quickly and easily removed from the product. Additionally, some purchasers may prefer a display package that is made from an environmentally sustainable material, such as recyclable plastic.

Manufacturers typically prefer a display package that is inexpensive and that highlights the saleable features of the product. Additionally, manufactures prefer a display package that is quickly and easily applied to a product. It is further desirable if the product can be packaged in the display package without any specialized tools or systems.

Based on the above, there exists a continuing need in the art to improve display packages for tools and tool accessories to the benefit of store operators, purchasers, and manufacturers.

SUMMARY

According to an exemplary embodiment of the disclosure, a package for at least one saw blade defining a post opening includes a body defining a support surface, a post, a wall, and a cover. The post extends from the support surface and is configured to extend through the post opening defined in the at least one saw blade. The wall extends from the support surface at least partially around the post. The cover is configured for connection to the wall and is further configured to be positioned adjacent to a free end of the post when connected to the wall to prevent removal of the post from the post opening when the at least one saw blade is mounted on the post.

According to another exemplary embodiment of the disclosure, a package assembly includes at least one saw blade defining a post opening and a package. The package includes (i) a body defining a support surface, (ii) a post extending from the support surface and configured to extend through the post opening of the at least one saw blade, (iii) a wall extending from the support surface at least partially around the post, and (iv) a cover configured for connection to the wall and further configured to be positioned adjacent to a free end of the post when connected to the wall to prevent removal of the post from the post opening when the at least one saw blade is mounted on the post.

According to yet another exemplary embodiment of the disclosure, a method of packaging at least one saw blade in a package includes extending a post of a package through a post opening of at least one saw blade, the post extending from a support surface of a body of the package; positioning a cover adjacent to a free end of the post; and connecting the cover to a wall of the package to prevent movement of the cover relative to the post, the wall extending from the support surface at least partially around the post.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
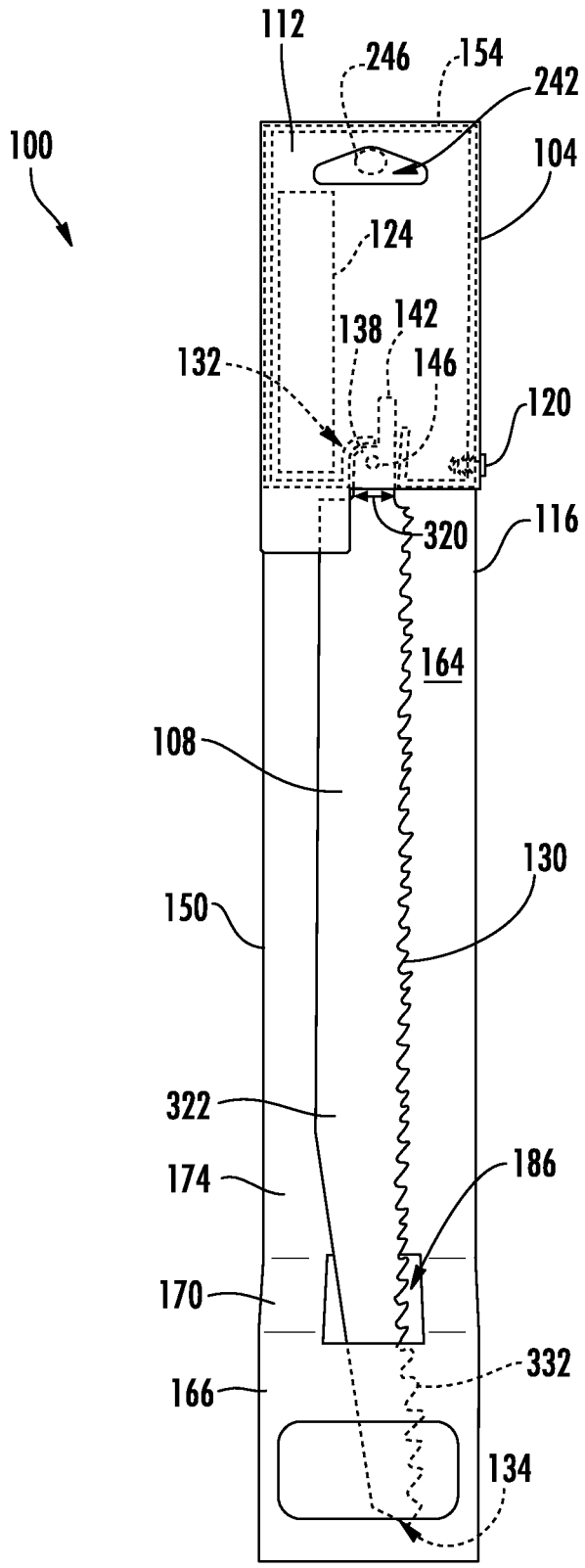
FIG. 1 is a front elevational view of a hang tag package assembly, as disclosed herein, including a hang tag package and a saw blade, portions of the hang tag package and the saw blade are shown in phantom.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

As shown in FIG. 1, a package, referred to herein as a hang tag package assembly 100, includes a hang tag package 104 and a saw blade 108. The hang tag package 104 includes a cover 112 (also shown in FIGS. 7-10) that is fastened to a support structure 116 with a fastener 120. A security device 124 is positioned between the cover 112 and the support structure 116. The package 104 is configured to conveniently display the saw blade 108 for sale, to protect the saw blade from tampering, and to be easily removed by a purchaser, as described in detail below.

The saw blade 108 includes a plurality of cutting teeth 130 and an attachment end 132 configured to be received by a power saw (not shown). The attachment end 132 includes a rounded shoulder 138 and a tang 142. The plurality of cutting teeth 130 extends from a tip 134 (opposite from the attachment end 132) of the saw blade 108 approximately to just before the tang 142. The rounded shoulder 138 is located opposite from the tip 134 and defines a post opening 146 therethrough. The tang 142 extends from the rounded shoulder 138. The rounded shoulder 138 and the tang 142 are, in one embodiment, provided as known structures as are commonly found on reciprocating saw blades usable with a reciprocating saw device (not shown). Depending on the embodiment, the saw blade 108 is between approximately two hundred to four hundred millimeters in length. In other embodiments, the saw blade 108 is provided as any desired saw blade having a similar structure with an opening (i.e. post opening 146) therethrough. For example, the saw blade 108 may also be provided as a hacksaw blade.

With reference to FIGS. 2 through 6, the support structure 116 may be formed from thermoplastic polymer such as nylon or polypropylene, and may be opaque, transparent, or translucent, depending on the embodiment. The support structure 116 may alternatively be formed from any other desired material, including recyclable materials.

The support structure 116 includes a body 150, a wall 154, an aperture flange 158, and a mounting structure 162. The body 150 includes a logo portion 166, an angled portion 170, and an elongate portion 174. The logo portion 166 defines a recess 178 configured to receive a manufacture's logo (not shown), provided as a sticker, badge, or other emblem structure. In another embodiment, the logo portion 166 is formed without the recess, in which case a manufacture's logo may be applied directly to the logo portion. The logo portion 166 may also be referred to herein as a lower portion of the body 150.

The angled portion 170 extends from the logo portion 166. As illustrated, the angled portion 170 is integrally formed as a monolithic part with the logo portion 166. The angled portion 170 is angled with respect to the logo portion 166 by approximately one hundred thirty-five degrees. In another embodiment, the angled portion 170 is angled (angle θ) with respect to the logo portion 166 by approximately one hundred-ten to one hundred-sixty degrees, or any other desired angle, including an angle θ of approximately ninety to one hundred-eighty degrees.

The elongate portion 174 extends from the angled portion 170 so as to be approximately parallel to and offset from the logo portion. The elongate portion 174 defines a generally planar support surface 164 of the body 150. In the illustrated embodiment, the elongate portion 174 is integrally formed as a monolithic part with the angled portion 170. The length of the elongate portion 174 as measured along axis 182 may be selected based on the length of the saw blade 108. Accordingly, the elongate portion 174 may have any desired length.

A lower blade opening 186 is defined by the body 150. In the illustrated embodiment, the blade opening 186 is defined by each of the logo portion 166, the angled portion 170, and the elongate portion 174. In another embodiment, the body 150 is formed without the blade opening 186. In yet another embodiment, the blade opening 186 is defined by (i) only the logo portion 166, (ii) only the angled portion 170, (iii) only the elongate portion 174, (iv) only the logo portion and the angled portion, or (v) only the angled portion and the elongate portion. The number of saw blades 108 that may be inserted through the opening 186 is based on the angle θ. Typically, a saw blade capacity of the package 104 is increased when θ is approximately ninety degrees.

The wall 154 extends from the support surface 164 at least partially around the post 258 and defines a cavity 190. The wall 154 includes a top portion 194 from which two side portions 198, 202 extend. Two bottom portions 206, 210 extend from the side portions 198, 202. In the illustrated embodiment, the top portion 194 is imperforate. Each side portion 198, 202 defines a respective detent opening 214, 218, and the side portion 202 defines a fastener opening 222 (also shown in FIG. 6). In another embodiment, the wall 154 (or at least a portion thereof) may also extend from the angled portion 170 and/or the logo portion 166, thereby resulting in a longer cavity 190.

Figure 4:
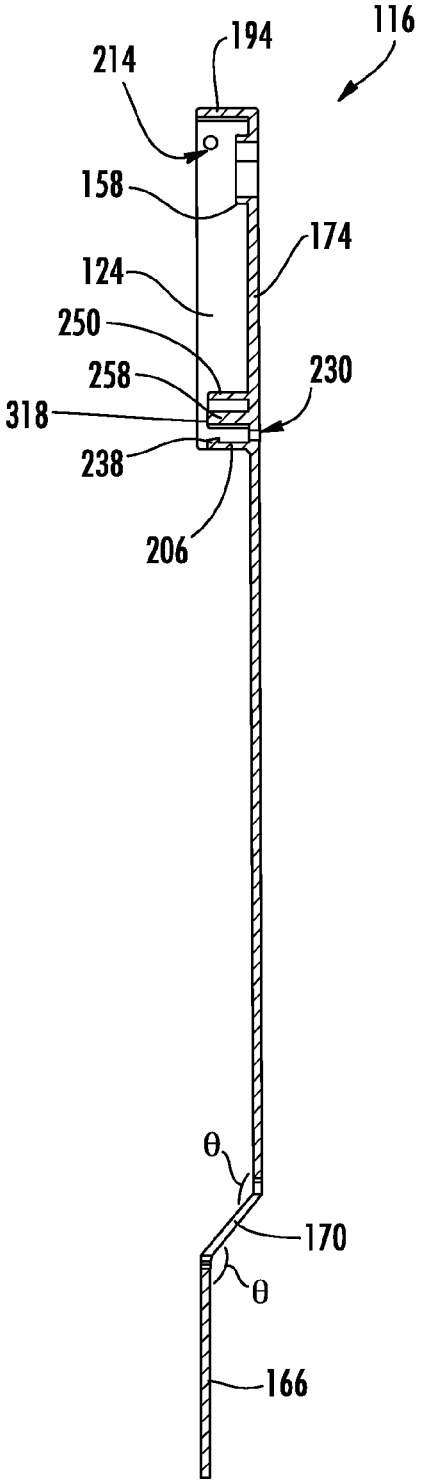
FIG. 4 is a cross sectional view taken along the line IV-IV of FIG. 3.
Figure 5:
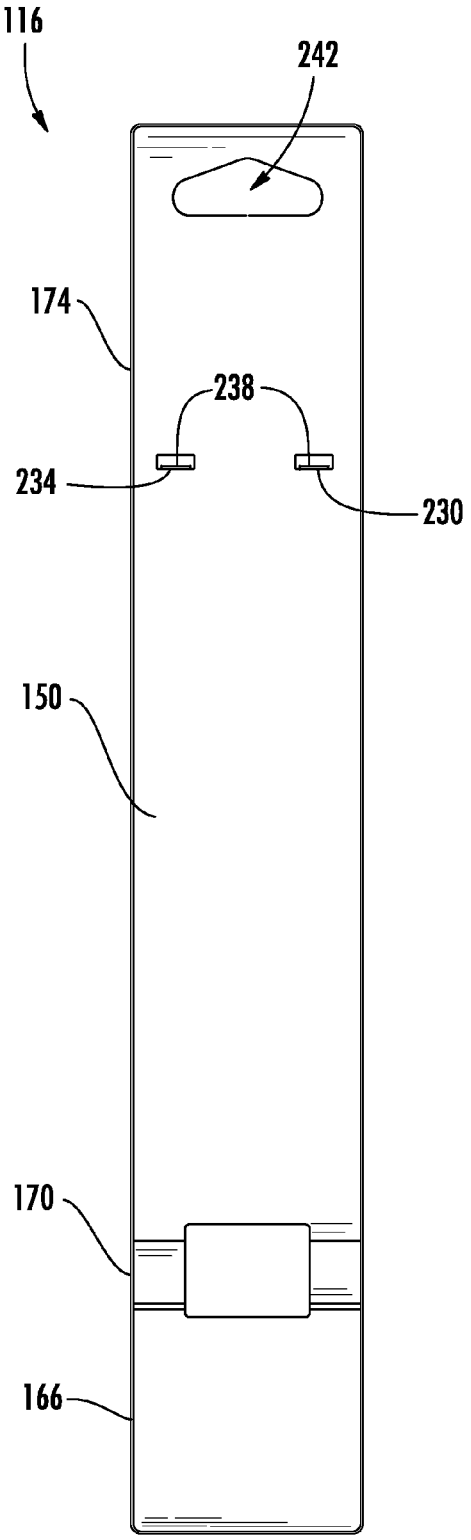
FIG. 5 is a rear elevational view of the support structure of FIG. 2.
Figure 6:
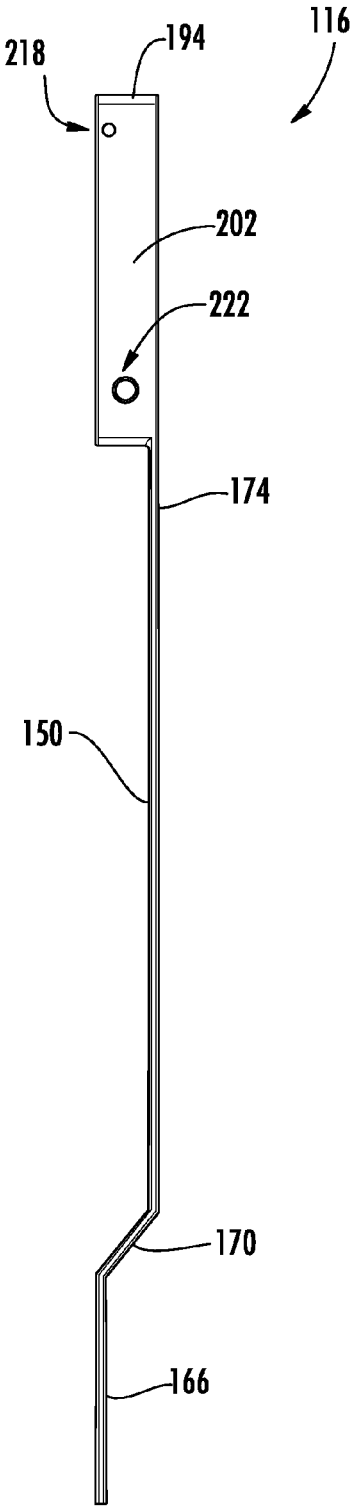
FIG. 6 is a side elevational view of the support structure of FIG. 2.
Figure 7:
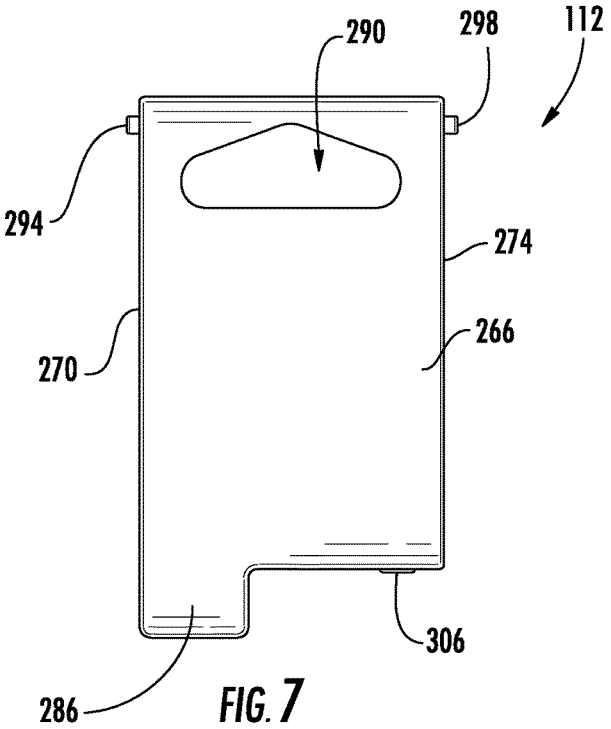
FIG. 7 is a front elevational view of a cover of the hang tag package of FIG. 1.
Figure 8:
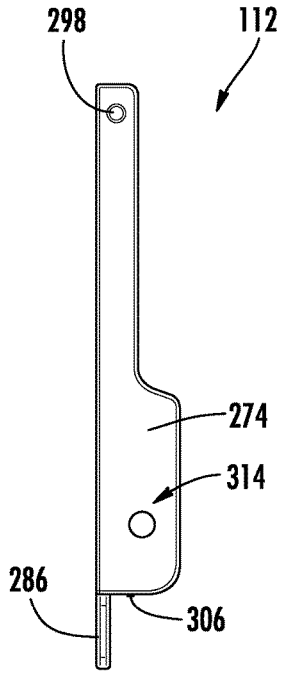
FIG. 8 is a side elevational view of the cover of FIG. 7.

A wall end 224 (FIG. 2) of the bottom portion 206 is separated from a wall end 228 (FIG. 2) of the bottom portion 210 by a blade passage 226 (FIG. 2) through which the saw blade 108 is configured to extend from the cavity 190. Each bottom portion 206, 210 is positioned adjacent to an access opening 230, 234 (FIGS. 3 and 5) to the cavity 190. Additionally, as shown in FIGS. 4 and 5, the bottom portions 206, 210 define a ridge 238, which may also be referred to herein as a vertex, located within the cavity 190.

With reference again to FIG. 2, the aperture flange 158 is formed in the elongate portion 174 and defines an opening 242 through the elongate portion that is configured to receive a hanging rod 246 (FIG. 1, also referred to herein as a support rod) or other hanging structure. The aperture flange 158 is configured to strengthen and stiffen the elongate portion 174 near the opening 242. In another embodiment, the support structure 116 does not include the aperture flange 158 and the opening 242 is defined by the elongate portion 174.

Figure 3:
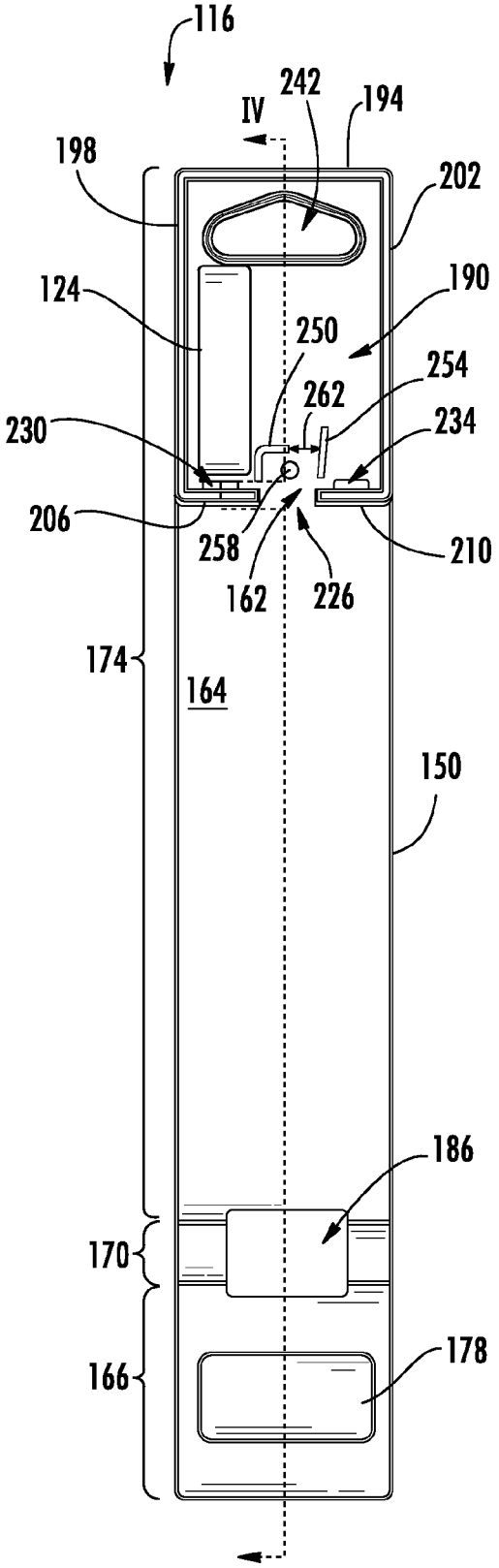
FIG. 3 is a front elevational view of the support structure of FIG. 2.

As shown in FIG. 3, the mounting structure 162 extends from the elongate portion 174 and includes an angled base element 250, a tang element 254, and a post 258. The base element 250 extends from the support surface 164, is located in the cavity 190, and defines a shape based on the shape of the rounded shoulder 138. In the illustrated embodiment, the base element 250 defines an approximately ninety degree rounded corner.

The tang element 254 extends from the support surface 164, is located in the cavity 190, and is substantially linear. The tang element 254 is angled with respect to the sidewalls 198, 202. A tang gap 262 is defined between the tang element 254 and the base element 250. The tang gap 262 is slightly greater in width than the width of the tang 142 to enable the tang to easily fit between the base element 250 and the tang element 254 without enabling excessive "play" between the tang and the elements 250, 254. In another embodiment, the tang element 254 is substantially parallel to the sidewalls 198, 202.

The post 258 extends from the support surface 164 and is located in the cavity 190 between the base element 250 and the tang element 254. The post 258 is configured to extend through the post opening 146 defined in the saw blade 108. In the illustrated embodiment, the post 258 defines a substantially frustoconical shape that is widest near the support surface 164 and is narrower near a free end 318 (FIG. 4) of the post. The widest portion of the post 258 is approximately equal to the diameter of the post opening 146. A length of the post 258 is greater than a thickness of the saw blade 108, such that more than one saw blade may be positioned on the post and supported by the mounting structure 162, if desired. In an exemplary embodiment, the post 258 supports at least five of the saw blades 108. In another embodiment, the post 258 defines a substantially cylindrical shape.

As shown in FIG. 3, the security device 124 is supported by the elongate portion 174 and is connected to the support surface 164 within the cavity 190. The security device 124 is typically secured to the elongate portion 174 with an adhesive, but may be connected using any desired method. The security device 124 may include an RFID tag or the like. In one embodiment, the elongate portion 174 defines a recess (not shown) that is configured to receive the security device 124. The security device 124 is shown in an exemplary position in FIG. 2, and in other embodiments, the security device is positioned at any desired position within the cavity 190, including being connected to the cover 112.

With reference to FIGS. 7-10, the cover 112 is substantially inflexible and is typically formed from same material as the support structure, but may be formed from any suitable material. The cover 112 includes a plate 266 and two sidewalls 270, 274 and a bottom wall 278 that extend from the plate. The plate 266 includes an aperture flange 282 (FIG. 10) and a tab 286. The aperture flange 282 defines an opening 290 through the plate 266 that is configured to receive the hanging rod 246 (FIG. 1). The aperture flange 282 is configured to strengthen and stiffen the plate 266 near the opening 290. The opening 290 is aligned with the opening 242. The sidewall 274 defines a fastener opening 314. In an alternative embodiment, instead of or in addition to the opening 314, the sidewall 274 includes a detent (not shown) that extends from the sidewall toward to the sidewall 202. The detent may be thermally sealed or fused to the sidewall 202.

The cover 112 is configured for connection to the wall 154 and includes two pivot detents 294, 298 and two locking detents 302, 306. The pivot detents 294, 298 extend outward from the sidewalls 270, 274 in opposite directions. The pivot detents 294, 298 are oppositely located and are configured to be received by the detent openings 214, 218 so that the cover 112 is pivotable between an open position (FIG. 11) in which the cover is spaced apart from the free end 318 of the post 258, and a closed position (FIG. 12) in which the cover is positioned adjacent to the free end of the post. The tab 286 extends outward from the plate 266 and is configured to be grasped to pivot the cover 112 relative to the support structure 116 about the pivot detents 294, 298. A blade space 310 is defined by the bottom wall 278.

The locking detents 302, 306 extend from the bottom wall 278 of the cover 112 away from the aperture opening 290. The locking detents 302, 306 are positioned directly in front of the access openings 230, 234 when the cover 112 is in the closed position. Additionally, the locking detents 302, 306 are configured to interlock with the ridge 238 (FIGS. 4 and 5) to secure the cover 112 in the closed position.

A method of packaging the saw blade 108 includes inserting the tip 134 of at least one saw blade 108 through the blade opening 186, such that a front portion 322 (FIG. 1) of the saw blade is positioned in front of the support surface 164 and a back portion 332 (FIG. 1) of the saw blade is positioned behind the support surface. Then, the post 258 is inserted through the post opening 146 formed in the rounded shoulder 138. With the post 258 inserted through the post opening 146, the base element 250 is positioned adjacent to the shoulder 138 and the tang element 254 is positioned adjacent to the tang 142.

Figure 2:
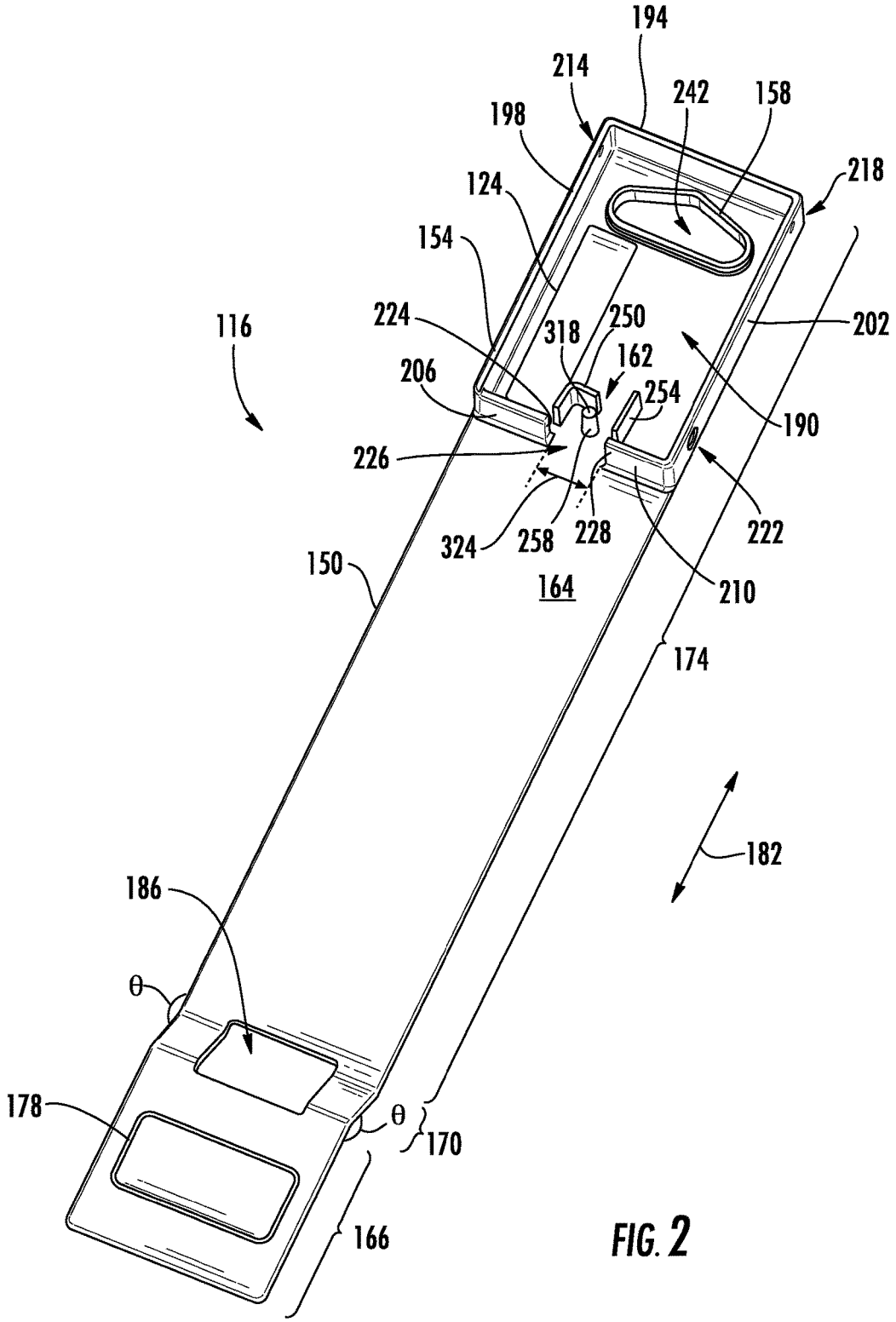
FIG. 2 is a perspective view of a support structure of the hang tag package of FIG. 1.

The hang tag package 104 is configured to support and to secure from one to ten saw blades 108, however, other embodiments may be configured to hold even more saw blades. As shown in FIGS. 1 and 2, a blade width 320 (FIG. 1) of the saw blade 108 is approximately the same a passage width 324 (FIG. 2) of the blade passage 226 to prevent access to the cavity 190 through the blade passage when at least one saw blade is supported on the post 258. Therefore, the tight fit between the saw blade 108 and the wall 154 prevents a user from attempting to pry the post 258 from the post opening 146 with a flat blade screwdriver (not shown).

Next, the security device 124 is connected to the elongated portion 174. Typically, this includes using an adhesive to connect the security device 124 to a desired position within the cavity 190 (such as the exemplary position shown in FIG. 2). Alternatively, the security device 124 is connected to the wall 154, to the cover 112, or to any other structure that is positioned within the cavity 190 including the saw blade 108.

Figure 11:
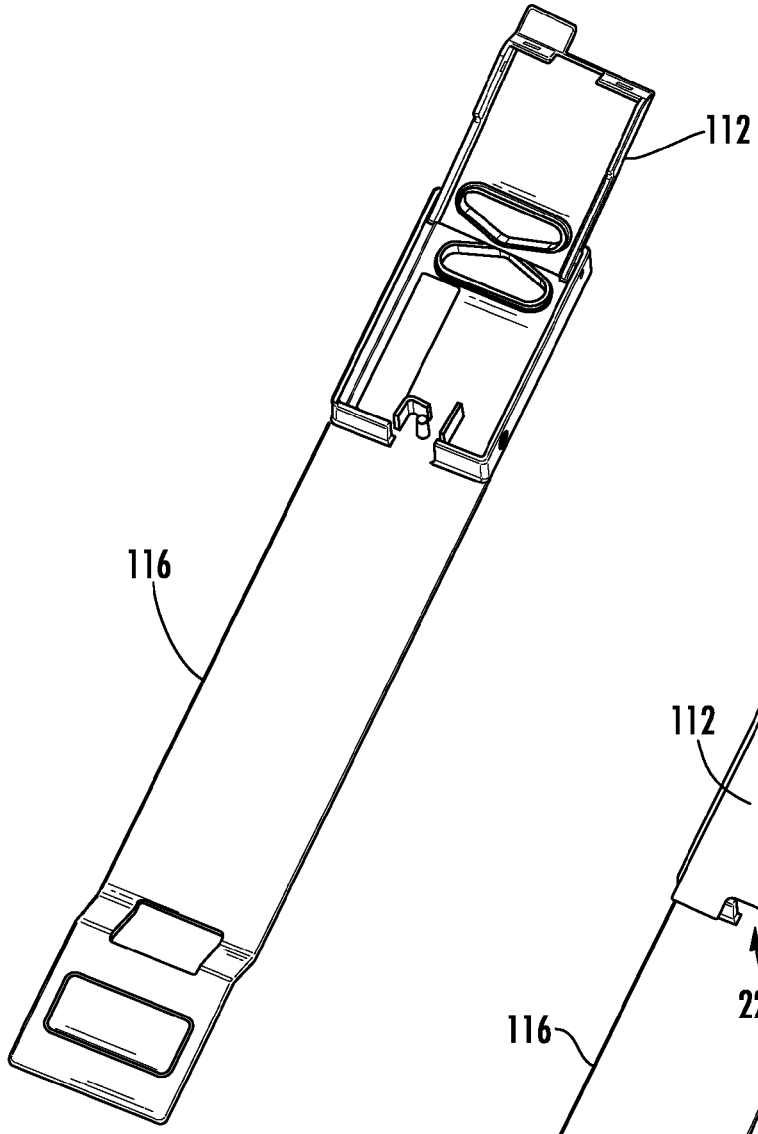
FIG. 11 is a perspective view of the hang tag package of FIG. 1, shown with the cover of FIG. 7 pivoted to an open position.
Figure 12:
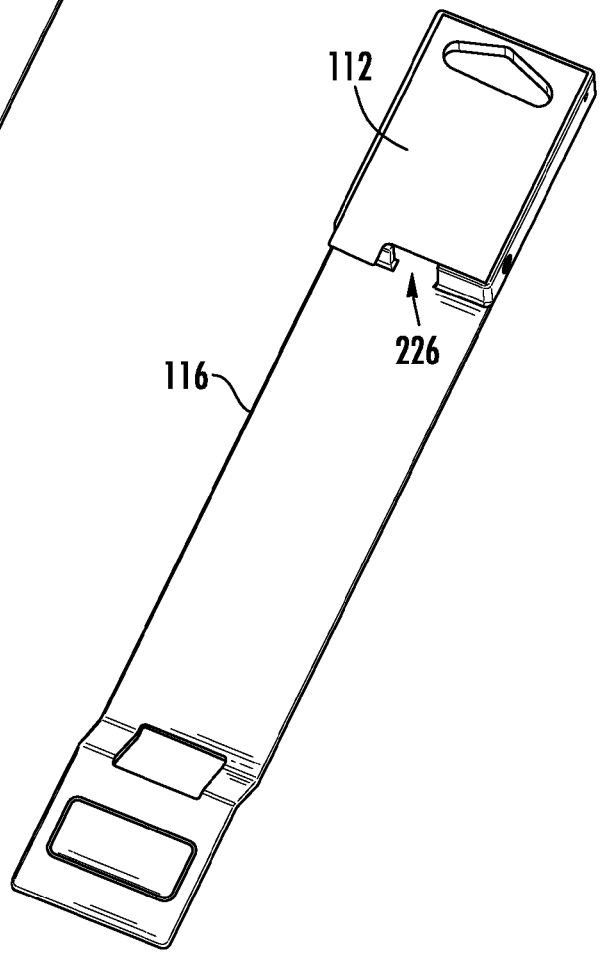
FIG. 12 is a perspective view of the hang tag package assembly of FIG. 1, shown with the cover of FIG. 7 pivoted to a closed position.

After the security device 124 is connected, the cover 112 is attached to the support structure 116. In particular, the cover 112 is connected to the wall 154 by inserting the pivot detents 294, 298 into the detent openings 214, 218, such that the cover 112 is configured in the open position (FIG. 11). Next, the cover 112 is pivoted toward the closed position (FIG. 12).

As the cover 112 approaches the closed position, the locking detents 302, 306 contact the ridge 238. Continued pivoting of the cover 112 moves the locking detents 302, 306 past the ridge 238 and secures the cover in the closed position. In particular, when the cover 112 is in the closed position, the locking detents 302, 306 engage the ridge 238 to lock the cover 112 in the closed position. When the cover 112 is in the closed position, it is prevented from being moved to the open position without the use of a separate tool (such as a flat blade screwdriver). Typically, damage to the cover and/or the support structure 116 may result if the cover is forced open without using a separate tool. Also, when the cover 112 is in the closed position, the opening 222 in the wall 154 is aligned with the opening 314 in the sidewall 274 of the cover. Furthermore, when the cover 112 is in the closed position, the post 258, the base element 250, and the tang element 254 are positioned adjacent to the plate 266 of the cover. In particular, on one embodiment, the post 258, the base element 250, and the tang element 254 are positioned directly against the cover in contact with the plate 266.

To further secure the cover 112 in the closed position and to connect the cover to the wall 154, next a security fastener 120 or other non-removable fastener, such as a push-in clip or a pine tree clip is inserted through the openings 222, 314, which are aligned with each other when the cover is in the closed position. The fastener 120 may be inserted by hand, such that no tools are required to package the saw blade(s) 108 in the hang tag package 104. After the fastener 120 is inserted through the openings 222, 314, it cannot be removed without being destroyed; accordingly, the fastener is "permanently" positioned in the openings. Additionally, when the fastener 120 is received by the openings 222, 314 the cover 112 is prevented from being moved to the open position without damaging the cover and/or the support structure 116, thereby making the hang tag package 104 extremely tamper resistant. The packaged saw blade(s) 108 may then be hung for display by inserting the rod 246 through the openings 242, 290.

Figure 9:
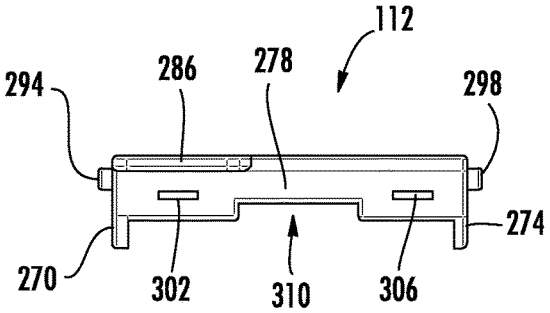
FIG. 9 is a bottom plan view of the cover of FIG. 7.
Figure 10:
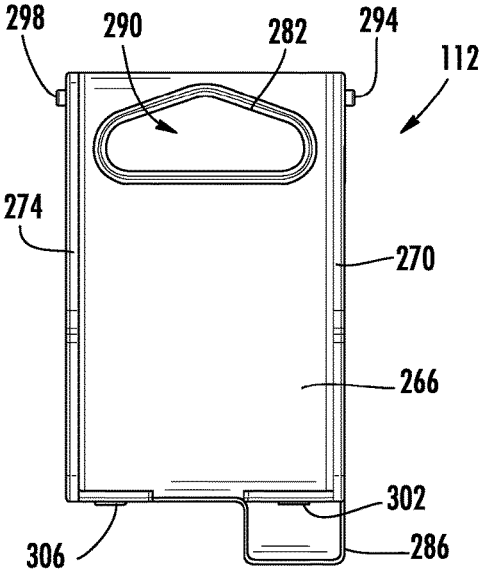
FIG. 10 is a rear elevational view of the cover of FIG. 7.

The structure of the hang tag package 104 prevents the saw blade 108 from being removed from the mounting structure 162 when the cover 112 is in the closed position. Specifically, when the cover 112 is in the closed position, the saw blade 108 is only movable on the post 258 within the blade space 310 (FIG. 9). Accordingly, the saw blade 108 is prevented from being moved to a position that enables the post 258 to be removed from the post opening 146. Additionally, when the cover 112 is in the closed position, the cover is positioned adjacent to the free end 318 (FIG. 2) of the post 258, thereby further preventing the post from being removed from the post opening 146 when at least one of the saw blades 108 is mounted on the post 258. In one embodiment, the cover 112 is positioned directly against the post 258 when the cover is in the closed position. In another embodiment, an element (not shown) is positioned between the cover 112 and the post 258 when the cover is in the closed position and the post is still prevented from being removed from the post opening 146.

The hang tag package 104 prevents separation of the saw blade 108 from the security device 124 before the saw blade is purchased. As describe above, the cover 112 is fixedly positioned in the closed position, which seals the security device 124 within the cavity 190. Also, in some embodiments, the presence of the security device 124 is unknown to an observer, since the security device may be obscured from view. Accordingly, the hang tag package 104 is useful for preventing theft of the saw blade 108 in a retail environment.

To unpackage the saw blade 108 a user breaks a portion of the hang tag package 104. In particular, the user removes the fastener 120 from the openings 222, 314, which destroys the fastener. The fastener 120 may be removed according to any desired technique. With the fastener 120 removed, the cover 112 is still secured in the closed position by the locking detents 302, 306. Accordingly, next the user inserts a flat blade screwdriver (not shown) into the opening 230 and pries the locking detent 302 away from the ridge 238. Then the user inserts the flat blade screwdriver into the opening 234 and pries the locking detent 306 away from the ridge 238. When both locking detents 302, 306 are pried away from the ridge 238 the cover can be moved to the open position to enable removal of the saw blade 108 from the mounting structure 162.

Figure 13:
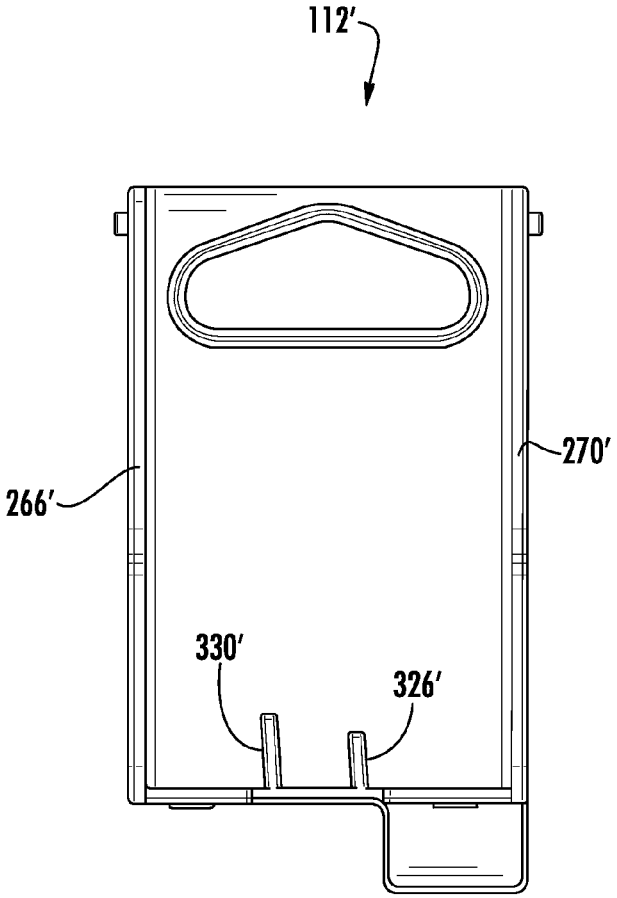
FIG. 13 is a rear elevational view of a cover of another embodiment of a hang tag package, as described herein, the cover is configured for use with the support structure of FIG. 2.
Figure 14:
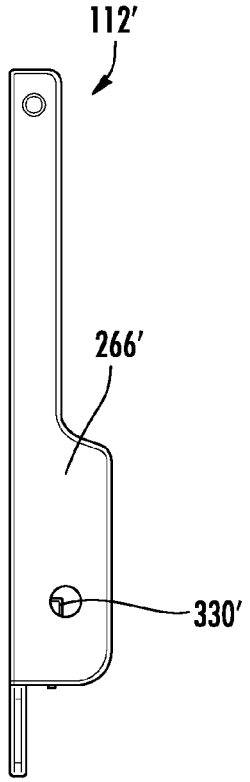
FIG. 14 is a side elevational view of the cover of FIG. 13.

As shown in FIGS. 13 and 14 in another embodiment, the cover 112' includes a first blocking element 326' and a second blocking element 330'. The blocking elements 326', 330' are angled with respect to the sidewalls 266', 270' of the cover 112'. Alternatively, the blocking elements 326', 330' are parallel to the sidewalls 266', 270'. The blocking elements 326', 330' are configured to be positioned between the base element 250 and the tang element 254 when the cover 112' is in the closed position so as to prevent tampering with the hang tag package 104. Except for including the blocking elements 326', 330' the cover 112' is identical to the cover 112.

Figure 15:
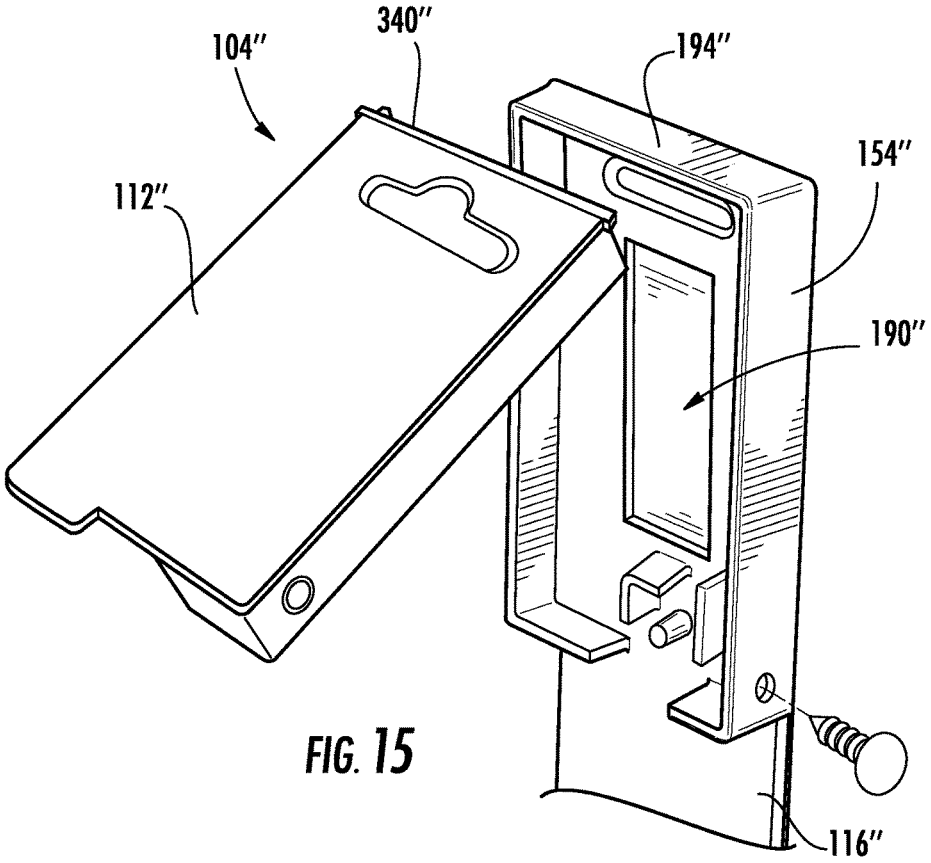
FIG. 15 is a perspective view of another embodiment of a portion of a hang tag package, as disclosed herein, the hang tag package includes a support structure and a cover that is received by a groove formed in a wall of the support structure.
Figure 16:
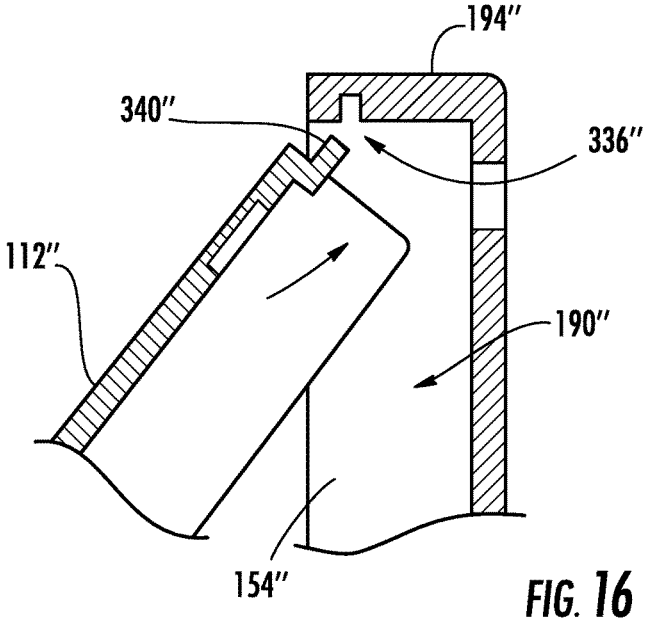
FIG. 16 is a cross sectional view of the hang tag package shown in FIG. 15.

As shown in FIGS. 15 and 16, another embodiment of a hang tag package 104" for use with the saw blade 108 includes a support structure 116" and a cover 112". The support structure 116" includes wall 154" having a top portion 194" that defines a groove 336" within the cavity 190". The cover 112" includes a ridge 340" having a shape that corresponds to a shape of the groove 336". The ridge 340" is configured to become interlocked with the groove 336" to secure an upper side of the cover 112" to the support structure 116". Accordingly, the support structure 116" does not include detent openings 214, 218 and the cover 112" does not include the pivot detents 294, 298. The support structure 116" and the cover 112" are in each other respect substantially identical to the support structure 116 and the cover 112.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A package for at least one saw blade including a post opening, the package comprising:

a body defining a support surface;

a post extending from the support surface and configured to extend through a post opening defined in the at least one saw blade;

a wall extending from the support surface at least partially around the post;

a cover configured for connection to the wall and further configured to be positioned adjacent to a free end of the post when connected to the wall to prevent removal of the post from the post opening when the at least one saw blade is mounted on the post, a fastener configured to extend through a first fastener opening defined by the wall and a second fastener opening defined by the cover to connect the cover to the wall.

2. The package of claim 1, further comprising:

at least one ridge formed in the wall; and at least one detent extending from the cover and configured to interlock with the at least one ridge to connect the cover to the wall.

3. The package of claim 1, wherein: the support surface, the wall, and the cover at least partially define a cavity in which the post is located; and the wall includes a first wall end spaced apart from a second wall end to define a blade passage from which the at least one saw blade extends from the cavity.

4. The package of claim 3, further comprising: a security device supported by the support surface, the wall, or the cover and located in the cavity.

5. A package assembly comprising:

at least one saw blade defining a post opening;

a package including (i) a body defining a support surface, (ii) a post extending from the support surface and configured to extend through the post opening of the at least one saw blade, (iii) a wall extending from the support surface at least partially around the post, and (iv) a cover configured for connection to the wall and further configured to be positioned adjacent to a free end of the post when connected to the wall to prevent removal of the post from the post opening when the at least one saw blade is mounted on the post; and a fastener configured to extend through a first fastener opening defined by the wall and a second fastener opening defined by the cover to connect the cover to the wall.

6. The package assembly of claim 5, wherein:

the support surface, the wall, and the cover at least partially define a cavity in which the post is located, the wall includes a first wall end spaced apart from a second wall end to define a blade passage from which the at least one saw blade extends from the cavity, and a passage width of the blade passage is substantially the same as a blade width of a portion of the at least one saw blade extending through the passage.

7. The package assembly of claim 5, wherein:

the at least one saw blade further defines an attachment end including a shoulder, a tang, and the post opening, and the package further comprises (i) a base element extending from the support surface and positioned adjacent to the shoulder and the cover when the cover is connected to the wall and the at least one saw blade is mounted on the post, and (ii) a tang element extending from the support surface and positioned adjacent to the tang and the cover when the cover is connected to the wall and the at least one saw blade is mounted on the post.

8. The package assembly of claim 5, further comprising:

at least one ridge formed in the wall; and at least one detent extending from the cover and configured to interlock with the at least one ridge to connect the cover to the wall.

9. The package assembly of claim 5, further comprising:

a security device supported by the body and positioned between the support surface and the cover.

10. A package assembly comprising:

at least one saw blade defining a post opening;

a package including (i) a body defining a support surface, (ii) a post extending from the support surface and configured to extend through the post opening of the at least one saw blade, (iii) a wall extending from the support surface at least partially around the post, and (iv) a cover configured for connection to the wall and further configured to be positioned adjacent to a free end of the post when connected to the wall to prevent removal of the post from the post opening when the at least one saw blade is mounted on the post, wherein the body defines a blade opening through which a portion of the at least one saw blade extends, such that a first portion of the at least one saw blade is positioned in front of the support surface and a second portion of the at least one saw blade is positioned behind the support surface.

11. The package assembly of claim 10, wherein:

the support surface, the wall, and the cover at least partially define a cavity in which the post is located, the wall includes a first wall end spaced apart from a second wall end to define a blade passage from which the at least one saw blade extends from the cavity, and a passage width of the blade passage is substantially the same as a blade width of a portion of the at least one saw blade extending through the passage.

12. The package assembly of claim 10, wherein:

the at least one saw blade further defines an attachment end including a shoulder, a tang, and the post opening, and the package further comprises (i) a base element extending from the support surface and positioned adjacent to the shoulder and the cover when the cover is connected to the wall and the at least one saw blade is mounted on the post, and (ii) a tang element extending from the support surface and positioned adjacent to the tang and the cover when the cover is connected to the wall and the at least one saw blade is mounted on the post.

13. The package assembly of claim 10, further comprising:

at least one ridge formed in the wall; and at least one detent extending from the cover and configured to interlock with the at least one ridge to connect the cover to the wall.

14. The package assembly of claim 10, further comprising:

a security device supported by the body and positioned between the support surface and the cover.

15. The package assembly of claim 10, wherein:

the wall defines a first fastener opening;

the cover defines a second fastener opening that is configured for alignment with the first fastener opening; and a fastener extends through the first fastener opening and the second fastener opening to connect the cover to the wall.

* * * * *